US005119976A

United States Patent [19]

Müller

[11] Patent Number: 5,119,976

[45] Date of Patent: Jun. 9, 1992

[54] PROCESS AND APPARATUS FOR INJECTING GAS INTO A DISCHARGE OPENING OF A METALLURGICAL VESSEL

[75] Inventor: Bruno Müller, Muhen, Switzerland

[73] Assignee: Stopinc Aktiengsellschaft, Baar, Switzerland

[21] Appl. No.: 176,183

[22] Filed: Mar. 31, 1988

[30] Foreign Application Priority Data

Jun. 5, 1987 [DE] Fed. Rep. of Germany ..... 3718890

[51] Int. Cl.[5] ..... B22D 41/08

[52] U.S. Cl. ..... 222/590; 222/603; 266/220

[58] Field of Search ..... 222/590, 591, 597, 600, 222/603; 266/45, 44, 236, 217, 271, 220

[56] References Cited

U.S. PATENT DOCUMENTS

| | | | |
|---|---|---|---|
| 3,253,307 | 5/1966 | Griffiths et al. | 222/603 |
| 3,502,134 | 3/1970 | Orehoski | 222/603 |
| 3,581,948 | 6/1971 | Detalle | 222/603 |
| 3,809,146 | 5/1974 | Andrzajak et al. | 266/220 |
| 3,931,913 | 1/1976 | Meier | 266/220 |
| 4,003,561 | 1/1977 | Cudby | 266/220 |
| 4,203,538 | 5/1980 | Lührsen | 222/603 |
| 4,219,188 | 8/1980 | Meier | 266/220 |

FOREIGN PATENT DOCUMENTS

| | | | |
|---|---|---|---|
| 2012691 | 10/1970 | Fed. Rep. of Germany . | |
| 2104561 | 2/1972 | Fed. Rep. of Germany | 222/603 |
| 1379236 | 1/1975 | United Kingdom . | |

*Primary Examiner*—S. Kastler

*Attorney, Agent, or Firm*—Wenderoth, Lind & Ponack

[57] ABSTRACT

A sliding closure unit includes a movable plate movable between open and closed positions to control the discharge of molten metal through an outlet opening of a metallurgical vessel. When the movable plate is in the closed position, a continuous flow of gas is injected from a gas supply system through the area of the movable plate confronting the outlet opening into the outlet opening. When a predetermined gas back pressure occurs in the gas supply system, indicative of solidification of molten metal in the outlet opening, at least one pressurized gas jet at a pressure of at least 12 bar is injected from a compressed gas supply system into the outlet opening, thereby clearing away any solidified metal from the outlet opening. This makes it possible to ensure that, when the movable plate is moved to the open position, the molten metal will be discharged through the outlet opening at a full flow rate of discharge.

15 Claims, 1 Drawing Sheet

PROCESS AND APPARATUS FOR INJECTING GAS INTO A DISCHARGE OPENING OF A METALLURGICAL VESSEL

BACKGROUND OF THE INVENTION

The present invention relates to a process and apparatus for injecting gas, particularly a purge or scavenging gas, into an outlet opening of a metallurgical vessel. More particularly, the present invention is directed to such a process and apparatus wherein a movable plate of a sliding closure unit moves between open and closed positions to control the discharge of molten metal through the outlet opening, and wherein when the movable plate is in the closed position a flow of purge or scavenging gas is supplied from a gas supply system through the area of the movable plate confronting the outlet opening into the outlet opening. It is known to employ such an arrangement to guard against the solidification or freezing of the molten metal or the formation of lumps of metal within the outlet opening, for example due to the molten metal being cooled by the walls of the outlet opening, or at least to maintain the molten metal fluid until the movable plate of the sliding closure unit next is moved to the open position, thereby to attempt to ensure full flow discharge of the molten metal. However, with known systems it has not always been possible to ensure that full flow discharge of the molten metal will occur upon moving the movable plate to the open position. Particularly, if the movable plate has been in the closed position for a substantial amount of time, the outlet opening becomes clogged or choked with solidified metal and must be burned free, for example with an oxygen lance. This process is complicated, time consuming and expensive.

West German Patent No. 3,506,426, corresponding to French Patent No. 2,577,828 and to U.S. patent application Ser. No. 831,917, filed Feb. 21, 1986, discloses a process for preventing metal deposits from forming in the outlet opening during discharge of molten metal through the outlet opening. For this purpose, there is provided both a continuous flow and also a pulse-like injection of gas, particularly an inert gas. These two gas flow injections are controlled to maintain the outlet opening clear.

SUMMARY OF THE INVENTION

With the above discussion in mind, it is an object of the present invention to provide an improved process and apparatus for ensuring a full flow discharge of molten metal through the outlet opening upon moving the movable plate of the sliding closure unit from the closed position to the open position.

It is a further object of the present invention to provide such a process and apparatus resultant from improved scavenging or purge gas injection into the outlet opening.

These objects are achieved in accordance with the present invention by, when a predetermined gas back pressure occurs in the continuous gas supply system and/or just before the movable plate is moved from the closed position to the open position, injecting into the outlet opening at least one pressurized gas jet at a pressure of at least 12 bar from a compressed gas supply system, thereby clearing away any solidified metal or molten metal tending to solidification from the outlet opening. In accordance with the present invention, it therefore is possible to ensure that, when the movable plate is moved from the closed position to the open position, the flow of molten metal through the discharge opening will be at a full rate of flow that is not impeded by solidified metal tending to clog or choke the outlet opening. This full flow discharge capability is ensured substantially completely in accordance with the present invention, and this is an important advantage and indeed a requirement in continuous casting plants, so that expensive interruption of the pouring/casting operation can be avoided.

In accordance with the present invention, the pressurized gas jet of purge or scavenging gas is injected for an adjustable time interval of very short duration, preferably only a fraction of a second.

In particular accordance with the present invention, the pressurized gas jet is supplied to the outlet opening through the area of the movable plate confronting the outlet opening, and such area is in the form of a plug in the movable plate, the continuous flow of gas and the pressurized gas jet being supplied through the plug into the outlet opening, preferably through orifices extending through the plug. In a specific embodiment of the present invention, three pressurized gas jets are directed symmetrically into the outlet opening. The plug may be formed of a refractory material that is permeable to the gas, such that the pressurized gas jet not only passes through the orifices in the plug but also through the material of the plug.

In accordance with the present invention, the predetermined back pressure that occurs within the continuous gas supply system and that initiates the injection of the pressurized gas jet is indicative of a consistency of the molten metal in the outlet opening tending toward solidification of the molten metal. In practice, this back pressure would be from approximately 5-50%, depending upon the particular installation of a given gas injection system and of the purge gas pressure employed. One skilled in the art would understand from the present disclosure the extent of back pressure necessary for a particular installation to achieve the object of the present invention.

In a preferred arrangement of the present invention, the compressed gas supply system includes a pressure tank storing a volume of pressurized gas capable of forming the pressurized gas jet and connected to the outlet opening by a normally-closed first line, and a compressed gas source connected to the pressure tank by a normally-open second line. When the pressurized gas jet is to be injected into the outlet opening, the first line is opened such that the pressurized gas is discharged as a pressure wave through the first line into the outlet opening, and the second line simultaneously is closed, thereby isolating the pressure tank from the compressed gas source. After the volume of pressurized gas is discharged from the pressure tank, the first line is closed and the second line simultaneously is open, thereby again charging the pressure tank with the volume of pressurized gas capable of forming a new pressurized gas jet. If the conditions in the nozzle opening still require the injection of a further gas jet, i.e. if the predetermined back pressure still exists, then the new pressurized gas jet is injected. This procedure will be repeated-as necessary, dependent upon the existence of the predetermined back pressure, to ensure that the outlet opening is maintained unclogged and unchoked by solidified metal. This manner of operation further ensures that pressure waves of identical gas quantities are produced in a simple manner and moreover are controllable without difficulty.

In accordance with a further feature of the present invention the pressurized gas jet may be of air, argon or other inert gas or a gas-solid mixture. The feature of the present invention that the pressurized gas jet or jets are injected through a porous refractory plug ensures that the purge or scavenging gas is distributed over the entire cross section of the outlet opening.

In the event that the orifices through the porous refractory plug become clogged, then when the movable plate is moved to the open position thereof, a pressurized gas jet may be injected through the plug to clear such clogged orifices. In this arrangement, when the movable plate is in the open position, the plug must be located in an unobstructed position, i.e. particularly outside the stationary plate of the sliding closure unit.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
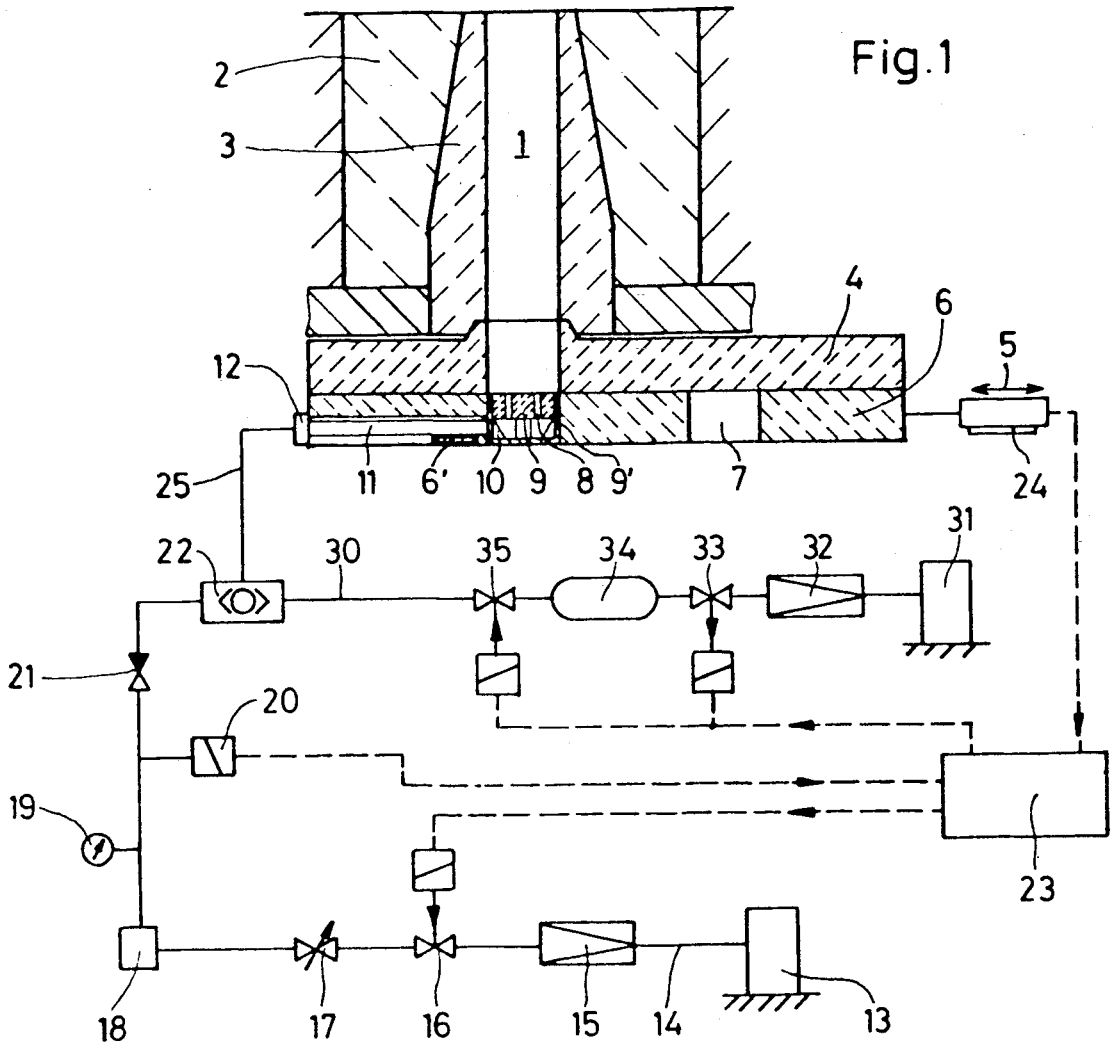
FIG. 1 is a schematic view, partially in section, of a sliding closure unit provided with a gas injection apparatus according to the present invention.

FIG. 1 schematically illustrates the bottom of a metallurgical vessel to contain molten metal and having a refractory lining including an outlet formed by a nozzle brick 2 having therethrough a nozzle sleeve 3 defining an outlet opening 1. Fixed in a conventional manner to the outer metal jacket of the metallurgical vessel is a sliding closure unit including a stationary refractory plate 4 having a discharge opening aligned with outlet opening 1 and a movable refractory plate 6 movable between a closed position shown in FIG. 1 and an open position whereat a discharge opening 7 aligns with the discharge opening in stationary plate 4 and outlet opening 1. In the schematic illustration of FIG. 1 it is contemplated that movable plate 6 be movable in opposite rectilinear directions indicated by double-headed arrow 5.

When the movable plate 6 is in the closed position shown in FIG. 1, a scavenging or purge gas, for example an inert gas as would be understood by one skilled in the art, is supplied into the outlet opening 1 to prevent or retard solidification of the molten metal located therein above movable plate 6. Particularly, such purge gas is supplied through orifices or tuyeres 8 of a refractory plug 9 disposed in that area of plate 6 that confronts outlet opening 1 when the movable plate is in the closed position. Plug 9 may be made from a material that would be understood by one skilled in the art, and particularly may be a gas permeable porous and high strength refractory material.

Particularly, the purge gas flows to orifices 8 from a gas chamber 10 provided within plate 6 beneath plug 9 and in communication with a gas channel 11 leading to the outer periphery of plate 6. Plug 9 and gas chamber 10 are enclosed within a metal casing 9' joined firmly to gas channel 11 to substantially avoid gas leakage. A gas supply connection 12 connects channel 11 to a purge gas supply line 14 originating from a purge gas source 13. Disposed within line 14, in series in the direction of gas flow therein, are a pressure reducing valve 15, a shut-off valve 16, a throttling valve 17, a flow controller 18, if necessary, a manometer 19, a pressure-responsive switch 20, a check-valve 21 and a double-acting check valve 22. Shut-off valve 16, preferably designed as a solenoid valve, is controlled by a processor or controller 23 which receives signals from pressure-responsive switch 20. Controller 23 also receives signals indicative of the position of plate 6 from a position sensor 24 of the actuator of the sliding closure unit. A branch line 25 of line 14 is connected between double-acting check valve 22 and gas supply connection 12.

Gas source 13 and lines 14, 25 supply a constant gas flow to gas supply connection 12, gas channel 11, gas chamber 10 and orifices 8. This constant flow is at a desired gas quantity which may be manually adjustable by throttling valve 17 and that is at a value controlled by downstream flow controller 18. In spite of this continuous supply of purge gas, which normally operates at a gas pressure of not above 10 bar, some molten metal above plug 9 within outlet opening 1 may solidify. If this occurs, then when the movable plate 6 is moved to the open position, the molten metal will not be discharged at a full flow rate.

However, when molten metal solidifies within the outlet opening 1, then this will result in a change in pressure, i.e. a back pressure, within lines 25, 14. The occurrence of such a back pressure, and particularly to a predetermined level as would be understood by one skilled in the art, results in the injection of a further flow of purge gas, and particularly a sudden or impulsive pressurized gas jet resulting from a pressure wave supplied to orifices 8. This supply of pressurized gas in the form of a-sudden- wave is at an energy sufficient to eliminate any obstructions in discharge opening 1 such as might result from solidification therein of the metal.

More particularly, a pressure tank 34 is capable of storing a volume of pressurized gas sufficient to form a suitable pressurized gas jet. Tank 34 is connected by a first pressure line 30 to double-acting check valve 22 and thereby to line 25, gas channel 11, gas chamber 10 and orifices 8. A compressed gas source 31, capable of supplying pressurized gas at a pressure of approximately 200 bar, is connected to tank 34 by a second line. First line 30 is normally closed by a shut-off valve 35. Within the second line are a pressure reducing valve 32 and a shut-off valve 33 that is normally open. Shut-off valves 33 and 35 preferably are solenoid valves and receive open and closed commands from processor or controller 23.

When the movable plate 6 is in the closed position, then controller 23 has opened shut-off valve 16 of line 14 so that a constant flow of gas is supplied to orifices 8 at a gas pressure set by pressure reducing valve 15. This gas pressure is sufficient to ensure at least that orifices 8 are not penetrated by the molten metal. The opening of valve 16 is achieved when controller 23 receives a signal from sensor 24 that plate 6 has moved to the closed position. If the condition of the molten metal within nozzle opening 1 changes during the period that the plate 6 is in the closed position, i.e. some of the molten metal tends to solidify and thereby tends to clog or choke the outlet opening, then there will be a progressively increasing back pressure within line 14. When this back pressure reaches a predetermined maximum pressure, then such condition will be detected by pressure operated switch 20 and will send a signal to controller 23. Controller 23 then will open shut-off valve 35 to thereby release a sudden pressure wave which passes through orifices 8 at sufficient pressure and energy to break loose any solidified melt that has formed on the walls of outlet opening 1. Any solidified metal broken loose from the walls of the outlet opening 1 is moved into hotter, molten zones in the nozzle outlet. The pressurized gas jet during passage to orifices 8 passes through that part of the common double-acting check valve 22 connected to pressure line 30 and line 25. This pressure wave is suddenly and immediately released from pressure tank 34. During normal operation, with valve 35 closed and with valve 33 open, compressed gas from source 31 is supplied to tank 34 to pressure tank 34 at a suitable pressure, for example of approximately 15-30 bar, such pressure being set by pressure reducing valve 32. The volume of tank 34 corresponds to a quantity of compressed gas necessary to achieve the object of the present invention in a given installation, i.e. the issuance of a sudden pressurized gas jet passing through orifices 8 at a pressure and energy level sufficient to remove any solidified metal from outlet opening 1. As soon as shut-off valve 35 is opened to release the pressure wave, shut-off valve 33 simultaneously is closed to shut off connection to source 31. Also, when the pressure wave is released from tank 34, the part of the double-acting check valve 22 connected to line 14 closes. It is however contemplated that by appropriate design of the valve, the connection in valve 22 to line 14 could remain open so that the pressurized gas jet would be superposed on or added to the constant gas flow through line 14. After the pressure wave is discharged from tank 34, then valve 35 again is closed and valve 33 again is opened to again charge tank 34 with a volume of pressurized gas capable of forming a new pressurized gas jet. If the predetermined back pressure still exists in line 14, or at a later time occurs therein, then the above sequence of operations is repeated to inject a new pressurized gas jet through orifices 8.

To ensure that metal jacket or casing 9' is not ejected downwardly upon the generation of the pressurized gas jet, a reinforcing plate 6' fixed to plate 6 is provided beneath gas channel 11 and is welded to- jacket 9'.

Figure 2:
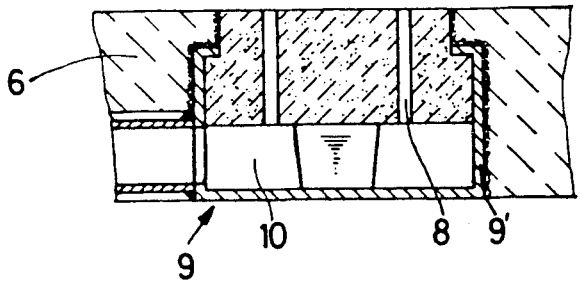
FIG. 2 is a cross section, on an enlarged scale, through a gas injection plug shown in FIG. 1.
Figure 3:
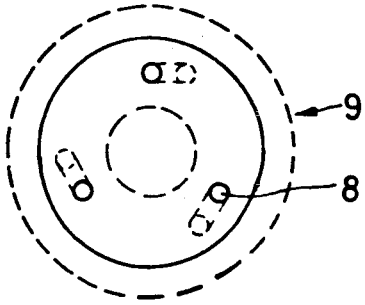
FIG. 3 is a top view of the plug shown in FIG. 2.

As shown in FIGS. 2 and 3, plug 9 has therethrough three orifices 8 formed by bores and having outlets disposed symmetrically around the axis of outlet opening 1. However, as shown by dashed lines in FIG. 3, orifices 8 may be inclined to the longitudinal axis to thereby impart a twist to the injected pressurized gas jets. Depending on the valve capacity, the diameter of the orifices 8 can be between 2 and 7 mm. Again, metal jacket 9' surrounds plug 9 as well as gas chamber 10 located therebeneath. It is however contemplated that the present invention include a plug with nonsymmetrically arranged orifices. Particularly, a plug with five nonsymmetrically disposed orifices has proved effective, such plug being formed of a porous gas permeable refractory material. One skilled in the art readily would understand from the present disclosure the types of materials that might be employed for plug 9.

A pressurized gas jet also may be released from tank 34 and injected into outlet opening 1 just before plate 6 is moved from the closed position to the open position, even if the predetermined back pressure is not detected. Thus, upon beginning opening movement of plate 6, sensor 24 signals controller 23 to open valve 35 in the manner discussed above.

As further will be apparent from a consideration of FIG. 1, in the event that some molten metal does penetrate orifices 8 and thereby solidifies therein, when the plate 6 is moved to the open position, a pressurized gas jet may be discharged from tank 34 to remove such solidified metal from orifices 8. In such an arrangement, plug 9 would have to be located beyond the perimeter of stationary plate 4.

Although the present invention has been described and illustrated with respect to preferred features thereof, it is to be understood that various changes and modifications may be made to the specifically described and illustrated features without departing from the scope of the present invention.

I claim:

1. In a process of injecting gas into an outlet opening of a metallurgical vessel, wherein a movable plate of a sliding closure unit moves between open and closed positions to control the discharge of molten metal through said outlet opening, and wherein when said movable plate is in said closed position a flow of gas is injected from a gas supply system through the area of said movable plate confronting said outlet opening into said outlet opening, the improvement comprising removing any metal solidified in said outlet opening before moving said movable plate from said closed position to said open position, and thereby ensuring full flow discharge of molten metal through said outlet opening upon moving said movable plate to said open position, said removing comprising:

when a predetermined gas back pressure occurs in said gas supply system or just before said movable plate is moved from said closed position to said open position, injecting into said outlet opening at least one pressurized gas jet in the form of an impulsive pressure wave, different from said flow of gas from said gas supply system, at a pressure of at least 12 bar from a compressed gas supply system, for a time interval of less than one second, thereby clearing away any solidified metal from said outlet opening.

2. The improvement claimed in claim 1, wherein said pressurized gas jet is supplied to said outlet opening through said area of said movable plate confronting said outlet opening.

3. The improvement claimed in claim 2, wherein said area comprises a plug in said movable plate, and said flow of gas and said pressurized gas jet are supplied through said plug into said outlet opening.

4. The improvement claimed in claim 3, wherein said pressurized gas jet and said flow of gas are injected through orifices extending through said plug.

5. The improvement claimed in claim 4, wherein said plug is permeable to said gas, and said pressurized gas jet also includes gas passed through the material of plug.

6. The improvement claimed in claim 2, comprising injecting a plurality of said pressurized gas jets through said area into said outlet opening.

7. The improvement claimed in claim 6, wherein said plurality of pressurized gas jets comprise three pressurized gas jets directed symmetrically into said outlet opening.

8. The improvement claimed in claim 1, wherein said time interval is adjustable.

9. The improvement claimed in claim 1, wherein said injecting occurs only when said predetermined back pressure is indicative of a consistency of said molten metal in said outlet opening tending toward solidification.

10. The improvement claimed in claim 1, wherein said pressurized gas jet is air, argon or a gas-solid mixture.

11. The improvement claimed in claim 1, wherein said compressed gas supply system comprises a pressure tank storing a volume of pressurized gas capable of forming said pressurized gas jet and connected to said outlet opening by a normally-closed first line, and a compressed gas source connected to said pressure tank by a normally-open second line, and said injecting comprises opening said first line such that said volume of pressurized gas is discharged as a pressure wave through said firs line into said outlet opening.

12. The improvement claimed in claim 11, further comprising closing said second line upon opening said first line, thereby isolating said pressure tank from said compressed gas source.

13. The improvement claimed in claim 12, further comprising, after said volume of pressurized gas is discharged from said pressure tank, closing said first line and opening said second line, thereby again charging said pressure tank with a volume of pressurized gas capable of forming a new pressurized gas jet.

14. The improvement claimed in claim 11, wherein said first line is connected to a line of said gas supply system leading to said outlet opening.

15. The improvement claimed in claim 1, further comprising, when said movable plate is in said open position, injecting a pressurized gas jet through said area of said movable plate that confronts said outlet opening when said movable plate is in said closed position.

* * * * *